US010655253B2

(12) United States Patent
Barea

(10) Patent No.: US 10,655,253 B2
(45) Date of Patent: May 19, 2020

(54) STORAGE YARN FEEDER WITH BRAKING ORGAN AND INTERCHANGEABLE ELEMENTS

(71) Applicant: BTSR INTERNATIONAL S.P.A., Olgiate Olona (VA) (IT)

(72) Inventor: Tiziano Barea, Busto Arsizio (IT)

(73) Assignee: BTSR INTERNATIONAL S.P.A., Olgiate Olona (VA) (IT)

( * ) Notice: Subject to any disclaimer, the term of this patent is extended or adjusted under 35 U.S.C. 154(b) by 82 days.

(21) Appl. No.: 15/746,972

(22) PCT Filed: Aug. 1, 2016

(86) PCT No.: PCT/IB2016/054607
§ 371 (c)(1),
(2) Date: Jan. 23, 2018

(87) PCT Pub. No.: WO2017/021860
PCT Pub. Date: Feb. 9, 2017

(65) Prior Publication Data

US 2019/0010637 A1 Jan. 10, 2019

(30) Foreign Application Priority Data

Aug. 3, 2015 (IT) ..... 102015000041326

(51) Int. Cl.
*D03D 47/34* (2006.01)
*D03D 47/36* (2006.01)
*D03D 47/27* (2006.01)

(52) U.S. Cl.
CPC ..... *D03D 47/366* (2013.01); *D03D 47/361* (2013.01); *D03D 47/365* (2013.01)

(58) Field of Classification Search
CPC .... B65H 51/22; B65H 51/30; B65H 2555/13; B65H 59/22; B65H 2511/30;
(Continued)

(56) References Cited

U.S. PATENT DOCUMENTS 3,693,904 A * 9/1972 Bucher ..... D03D 47/00 242/131
4,498,639 A * 2/1985 Deborde ..... D03D 47/363 242/365.5
(Continued)

FOREIGN PATENT DOCUMENTS

DE 29518090 U1 4/1997
EP 0286860 A1 10/1988
(Continued)

OTHER PUBLICATIONS

International Search Report and Written Opinion dated Nov. 18, 2016 for PCT/IB2016/054607 to BTSR International S.P.A. filed Aug. 1, 2016.

*Primary Examiner* — Robert H Muromoto, Jr.

(74) *Attorney, Agent, or Firm* — Vorys, Sater, Seymour and Pease LLP

(57) ABSTRACT

A storage yarn feeder includes a body having a portion or drum onto which winds a yarn forming at least one coil, the yarn coming from a reel, being provided with a braking organ cooperating with the drum to brake the yarn leaving the drum, the braking organ including braking features capable of cooperating with the yarn when the yarn detaches from the drum as it leaves the feeder and heads towards a textile machine. The drum includes a first and a second portion, the latter being capable of supporting the yarn and being separable from the first portion to be capable of being replaced, the first portion being connected to the body of the feeder.

17 Claims, 4 Drawing Sheets

(58) Field of Classification Search
CPC .. B65H 59/388; B65H 51/20; B65H 2220/01; B65H 2402/10; B65H 51/02; B65H 59/18; B65H 59/26; B65H 61/00; B65H 63/086; B65H 2555/23; D03D 47/364; D03D 47/366; D03D 47/34; D03D 47/361; D03D 47/347; D03D 47/367; D03D 47/363; D03D 2700/1404; D03D 47/00; D03D 47/362
See application file for complete search history.

(56) References Cited

U.S. PATENT DOCUMENTS

| | | | | | |
|---|---|---|---|---|---|
| 4,614,311 | A * | 9/1986 | Kakinaka | D03D 47/361 | 139/452 |
| 4,785,855 | A * | 11/1988 | Benz | B65H 59/22 | 139/452 |
| 4,828,192 | A * | 5/1989 | Sarfati | D03D 47/364 | 242/364.8 |
| 5,316,051 | A * | 5/1994 | Zenoni | D03D 47/366 | 139/452 |
| 8,418,506 | B2 * | 4/2013 | Barea | B65H 61/00 | 66/126 R |
| 9,067,755 | B2 * | 6/2015 | Barea | B65H 49/16 | |
| 9,102,500 | B2 * | 8/2015 | Barea | D03D 47/361 | |
| 9,126,799 | B2 * | 9/2015 | Barea | B65H 51/22 | |
| 9,181,064 | B2 * | 11/2015 | Barea | B65H 51/30 | |
| 9,303,338 | B2 * | 4/2016 | Bertocchi | D03D 47/347 | |
| 9,353,468 | B2 * | 5/2016 | Bertocchi | D03D 47/00 | |
| 9,475,670 | B2 * | 10/2016 | Barea | B65H 51/22 | |
| 9,562,308 | B2 * | 2/2017 | Barea | D04B 15/482 | |
| 9,598,261 | B2 * | 3/2017 | Barea | B65H 51/22 | |
| 9,656,830 | B2 * | 5/2017 | Barea | B65H 51/20 | |
| D794,683 | S * | 8/2017 | Barea | D15/78 | |
| D794,715 | S * | 8/2017 | Barea | D15/78 | |
| 9,828,208 | B2 * | 11/2017 | Barea | B65H 51/22 | |
| 10,280,032 | B2 * | 5/2019 | Barea | D03D 47/367 | |
| 2006/0131459 | A1 * | 6/2006 | Barea | D02G 3/32 | 242/554 |
| 2012/0217337 | A1 * | 8/2012 | Barea | B65H 49/16 | 242/563 |
| 2012/0285205 | A1 * | 11/2012 | Barea | D04B 15/48 | 66/132 R |
| 2013/0056573 | A1 * | 3/2013 | Barea | B65H 51/30 | 242/420.5 |
| 2013/0119177 | A1 * | 5/2013 | Barea | B65H 51/22 | 242/365.7 |
| 2013/0193251 | A1 * | 8/2013 | Barea | D03D 47/361 | 242/365.1 |
| 2014/0291435 | A1 * | 10/2014 | Barea | D04B 15/482 | 242/417 |
| 2014/0299703 | A1 * | 10/2014 | Barea | B65H 51/22 | 242/364.7 |
| 2014/0306051 | A1 * | 10/2014 | Barea | B65H 51/22 | 242/418 |
| 2015/0274482 | A1 * | 10/2015 | Barea | B65H 51/22 | 242/418.1 |
| 2016/0096703 | A1 * | 4/2016 | Barea | B65H 51/20 | 226/158 |
| 2018/0029823 | A1 * | 2/2018 | Barea | D03D 47/367 | |
| 2018/0038023 | A1 * | 2/2018 | Barea | D04B 15/99 | |
| 2019/0010637 | A1 * | 1/2019 | Barea | D03D 47/361 | |

FOREIGN PATENT DOCUMENTS

| | | |
|---|---|---|
| EP | 2014809 A1 | 1/2009 |
| EP | 2780271 | 9/2014 |
| GB | 2069184 A | 8/1981 |
| WO | 9114032 A1 | 9/1991 |

* cited by examiner

STORAGE YARN FEEDER WITH BRAKING ORGAN AND INTERCHANGEABLE ELEMENTS

CROSS-REFERENCE TO RELATED APPLICATIONS

This is a § 371 National Stage Application of International Application No. PCT/IB2016/054607 filed on Aug. 1, 2016, claiming the priority of Italian Patent Application No. 102015000041326 filed on Aug. 3, 2015.

This invention relates to a storage yarn feeder according to the pre-characterising clause of the main claim.

As is known, a conventional storage yarn feeder comprises a body to which is associated a drum onto which the yarn that comes from a reel is wound. This drum can be fixed, in which case an organ that deposits the yarn in a coil onto the drum is associated with the body of the feeder; alternatively, this drum rotates about its longitudinal axis driven by an electric motor associated with said body of the feeder.

Advantageously, a braking organ enabling the tension of the yarn leaving the drum and directed towards the textile machine that is to use it in order to produce manufactured items or their parts is associated with such a storage feeder. Conventionally, this braking organ comprises a conical or cupped body, usually made of a plastics or similar material, capable of pressing the yarn against an end part of the drum so as to brake it to a greater or lesser extent, but in a controlled manner; this is so as to regulate the tension of the yarn during the phase when it is taken up by the textile machine or in any event in the phase in which the yarn leaves the feeder to be sent to said machine.

Various types of braking organs are known and, in particular, various methods of controlling their braking action on the yarn.

In one of these types, the conical body is held in position and pressed against the drum by one or more springs whose force determines the average tension of the outgoing yarn. These springs have the task not only of "pressing" the conical body onto the drum, but also of acting as a shock-absorber if a knot is present in the thread by allowing said body to detach itself from the drum to prevent the yarn from breaking.

In another solution, the conical body is held in position and pressed against the drum by one or more opposing magnets; the intensity of the magnetic field generated determines the average tension of the outgoing yarn. This "magnetic" solution not only allows the conical body to be pressed against the drum, but also to act as a shock-absorber if a knot is present by enabling said body to detach itself from the drum allowing the knot to pass so as to prevent the yarn from breaking.

In another solution, the braking organ comprises a brush, a plastic ring secured to the end of the drum that provides bristles that tend to resist the take up of the yarn by the textile machine thus controlling its winding tension.

The above-mentioned feeders usually enable manual adjustment of braking.

Since the compression of the above-mentioned yarn can cause damage or wear to that part of the drum onto which the yarn is wound (wear) and thus change its "braking" capacity, the operator is required periodically to check the device since no automatic take-up by the device is envisaged. In fact, this change in the braking capacity involves a variation in the tension of the outgoing yarn, both in terms of absolute value and quality, causing the production of defective manufactured items.

In order partially to overcome these limitations, storage feeders have been produced that comprise a tension sensor capable of detecting the tension of the outgoing yarn and electronically regulating the pressure of the braking organ, as described for example in EP2014809 A1 or EP2780271.

In particular, these feeders have electronic control means associated with a sensor capable of measuring the tension of the outgoing yarn and varying the mechanical position of the braking body of the braking organ by means of an electric stepper motor so as to control and regulate the average tension of the outgoing yarn.

However, in these feeders too, the yarn can wear the drum or braking organ. In fact, the latter exerts a continuous pressure on this yarn which, during its feed to the machine, acts and presses on both surfaces, the first forming part of the drum onto which the yarn is wound and the second being that of the body of the braking organ.

The tension of the yarn is therefore the result of a series of frictions generated between the yarn and the two above-mentioned (contact) surfaces. These frictions are a function of the materials used to make the drum and braking organ, a function of their surface finish and, obviously, depend on the yarn itself. On one in the same feeder provided with a braking organ there would in fact be friction coefficients that differ as the type of yarn varies.

Clearly, therefore, the choice of materials and finish of the drum and braking organ determine the final tension of the yarn both in terms of absolute value (minimum settable tension, maximum settable tension) and in terms of the quality of the tension expressed as a ratio between the average tension and the difference between maximum peaks and minimum peaks. This tension is the tension at which the yarn is fed to the textile machine and that determines the quality of the manufactured item produced.

Furthermore, the outgoing tension from the feeder could for example have the correct average value but, due to the finish of the two braking surfaces and the characteristics of the yarn, could oscillate at high frequency (maximum peaks followed by minimum peaks), which would cause a defect in the finished product.

Also, since the contact of the yarn with the surfaces of said drum and braking organ leads to wear of said surfaces, the tension of the yarn both in terms of absolute value (maximum tension and minimum tension) and quality (ratio between the average tension and the difference between maximum peaks and minimum peaks) can change over time.

Some additional technical solutions are shown, for example, in WO91/14032 which describes a braking device that cooperates with a yarn feeder of a loom or, in DE29518090, which refers to a yarn storage and feed device that can be used on looms or weaving machines or, also, in GB2069184 which refers to a strand feeding system of a weaving device.

One of the main limitations of the state-of-the-art solutions is to have a feeder whose drum cannot be easily removed or replaced; consequently, in the case of a worn or damaged drum it is not possible to replace it easily but requires the entire feeder to be removed from the machine.

Another consequence of the non-interchangeable drum is the impossibility of optimising control of the tension as and when the machining operations or types of yarn vary. The only element that is currently and easily interchangeable on feeders available on the market is the conical body of the braking organ and intervention on this alone might not always be sufficient to achieve the desired constant tension of the yarn.

Furthermore, when feeding particularly abrasive yarns or threads fed at high speed, the yarn itself (interacting with the braking organ and the drum) could change the surface characteristics of these elements, for example by changing their roughness ("smoothing/polishing" effect). In this case too, in the solutions described by the state of the art, changing the conical body of the braking organ is a simple matter, but nothing can be done as regards the drum: once damaged, it must be replaced in its entirety.

In addition to this, it should be remembered that the operator him/herself, when "threading" the yarn between the braking organ and the drum or during possible maintenance operations could damage the drum, for example with a small knife used to remove the yarn.

It is therefore clear that the fact of not being able to change the drum in a simple manner represents a major limitation of the known solutions both in terms of flexibility (does not allow the elements that make up the feeder to be optimised to suit variations in the type of feed yarn) and maintenance (it is not possible easily to replace a damaged or worn drum).

The aim of this invention is to offer a storage yarn feeder equipped with a braking organ that has elements, capable of interacting with the yarn during braking, that can be easily interchanged with each other to guarantee maximum flexibility in terms of use (i.e. different elements for different yarns or applications) and the replacement of any damaged or worn parts.

Another aim is to provide a feeder of the type described wherein the replacement of said elements can be achieved easily so as to enable their replacement directly on the textile machine in which they are installed.

Another aim is to create a feeder in which not only is the entire braking organ easily interchangeable, but also so too is at least part of the drum onto which the yarn winds.

These and other aims, that will be obvious to a person skilled in the art, will be achieved by a storage yarn feeder with a braking organ according to the main claim.

For a better understanding of this invention, the following drawings are attached purely by way of non-limiting examples, in which.

Figure 1:
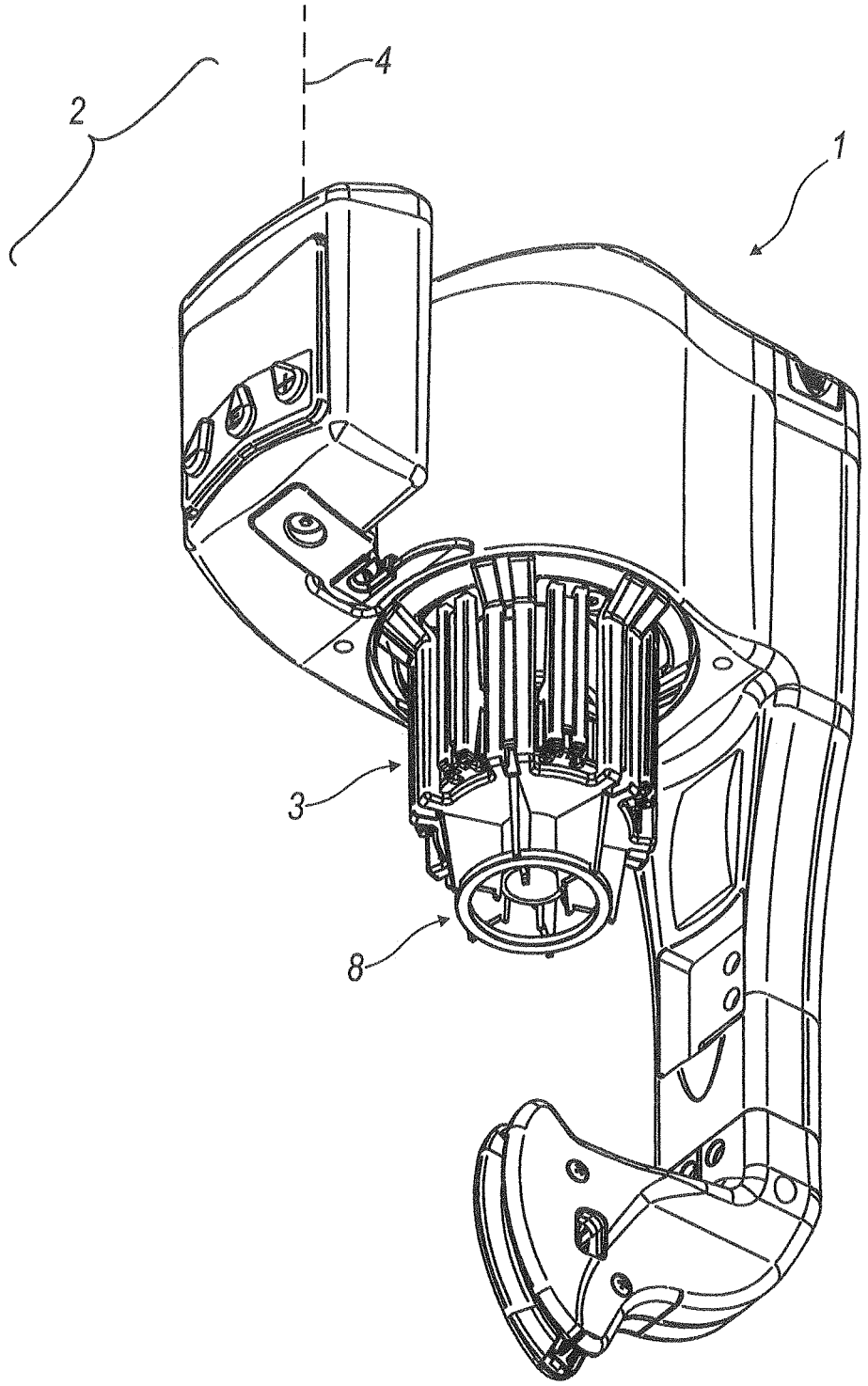
FIG. 1 is a perspective view slightly from below of a feeder according to the invention.
Figure 2:
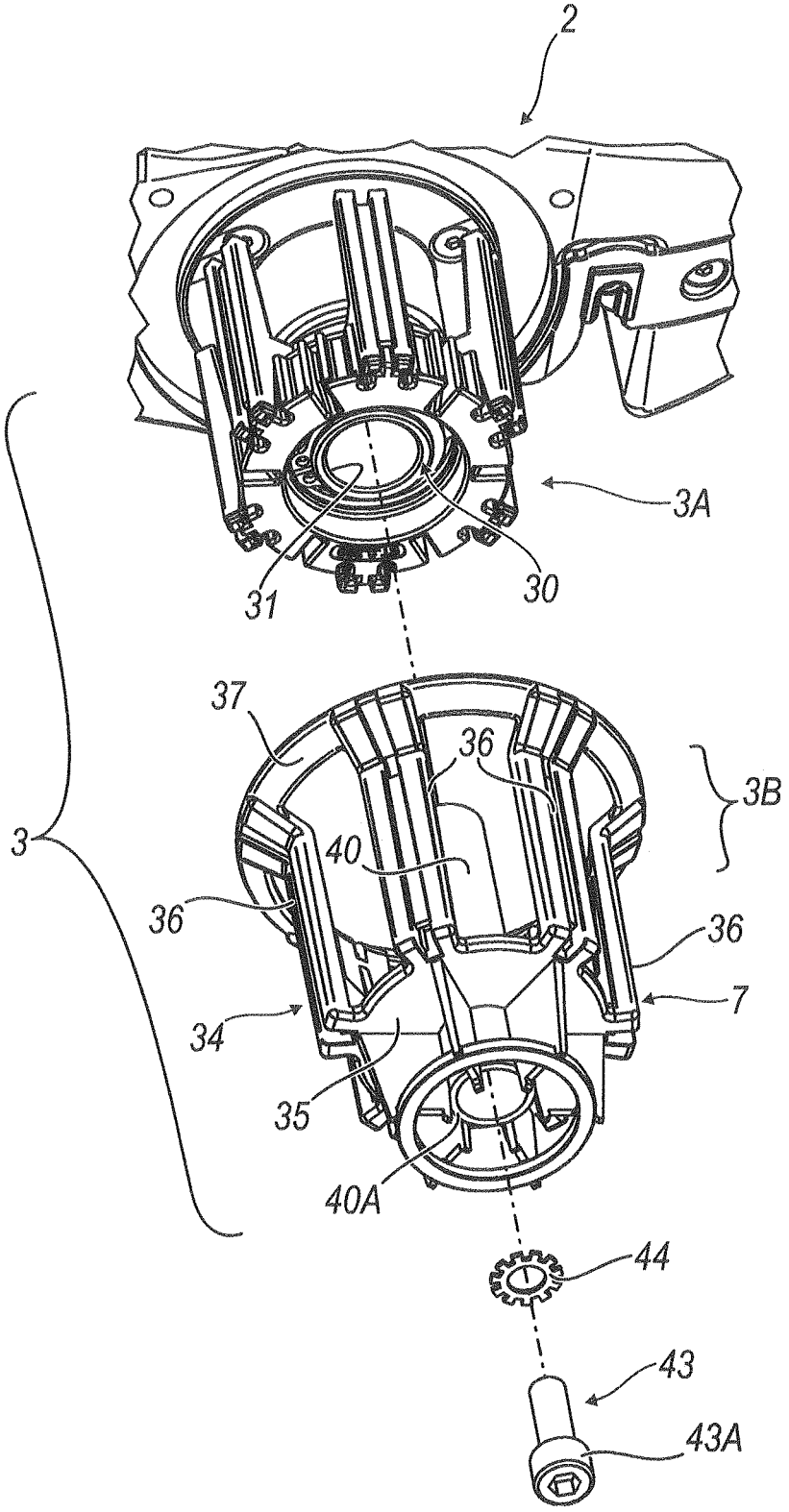
FIG. 2 is an exploded perspective view from below of a part of the feeder shown in FIG. 1.
Figure 3:
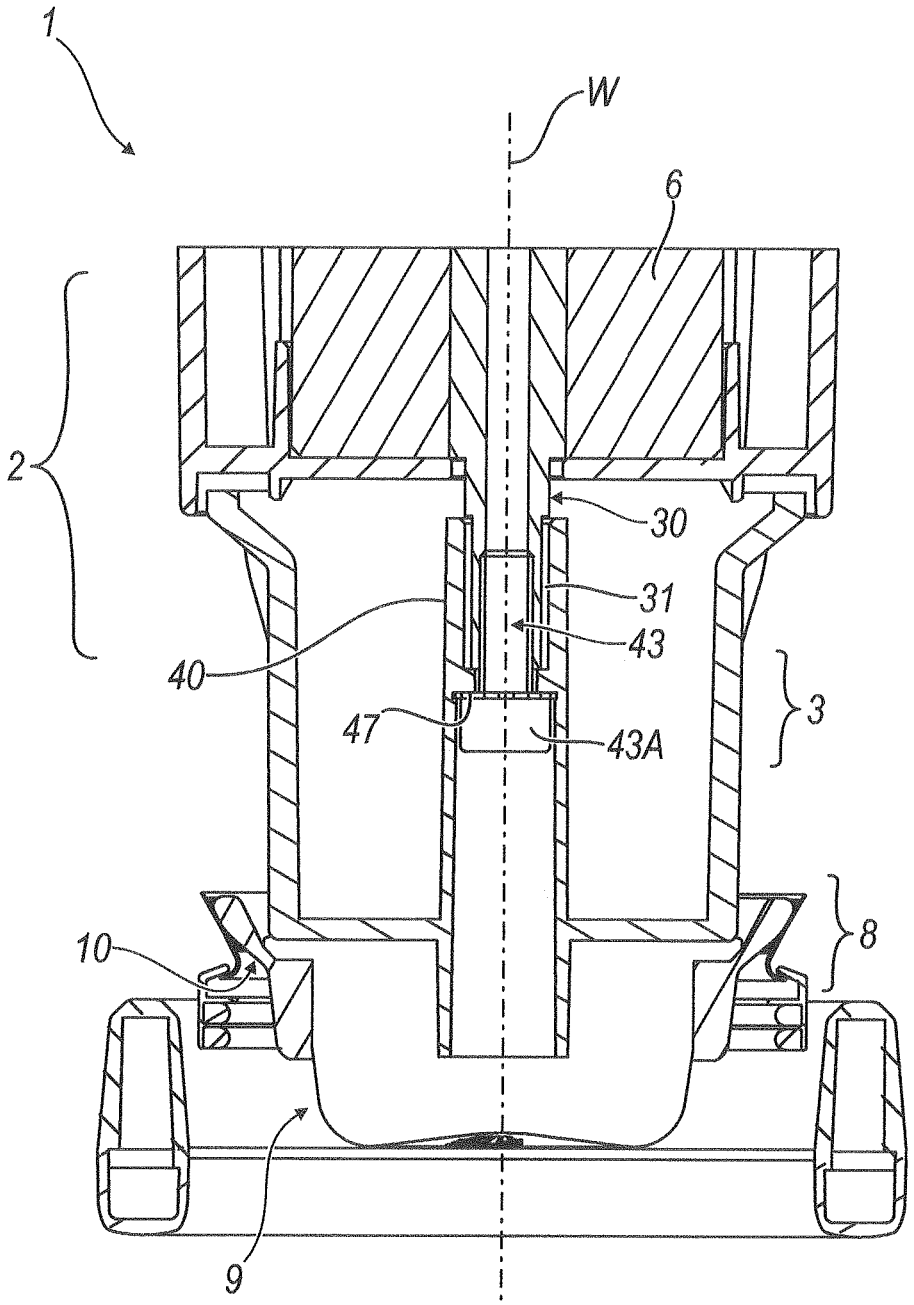
FIG. 3 is a cross-section along line 3-3 in FIG. 1.
Figure 4:
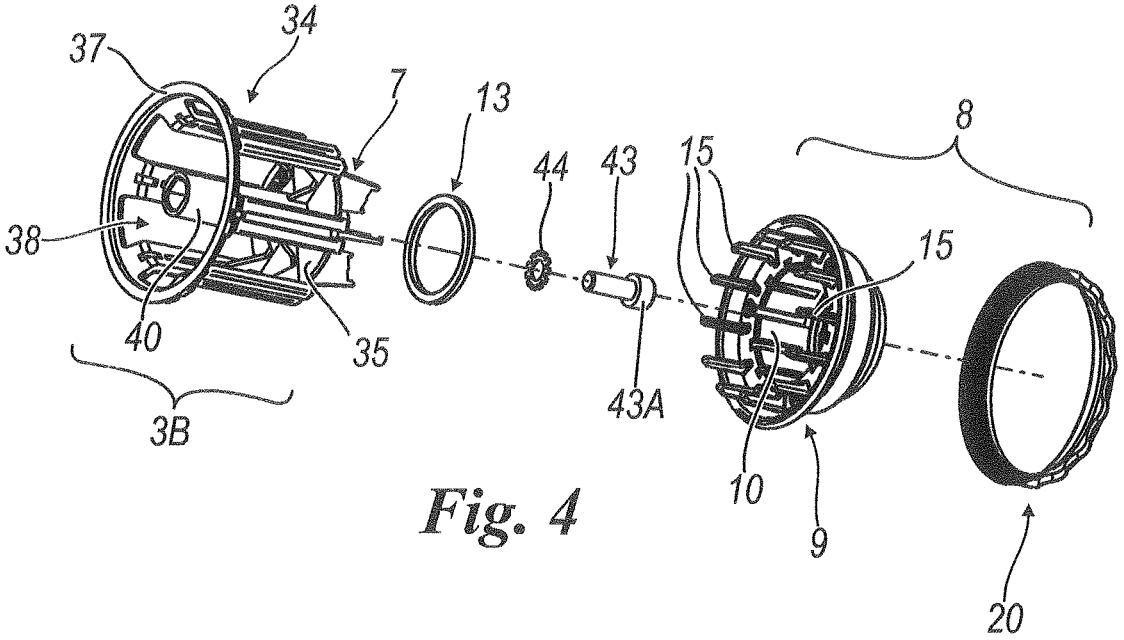
FIG. 4 is an exploded perspective view of a terminal part of the feeder shown in FIG. 1.
Figure 5:
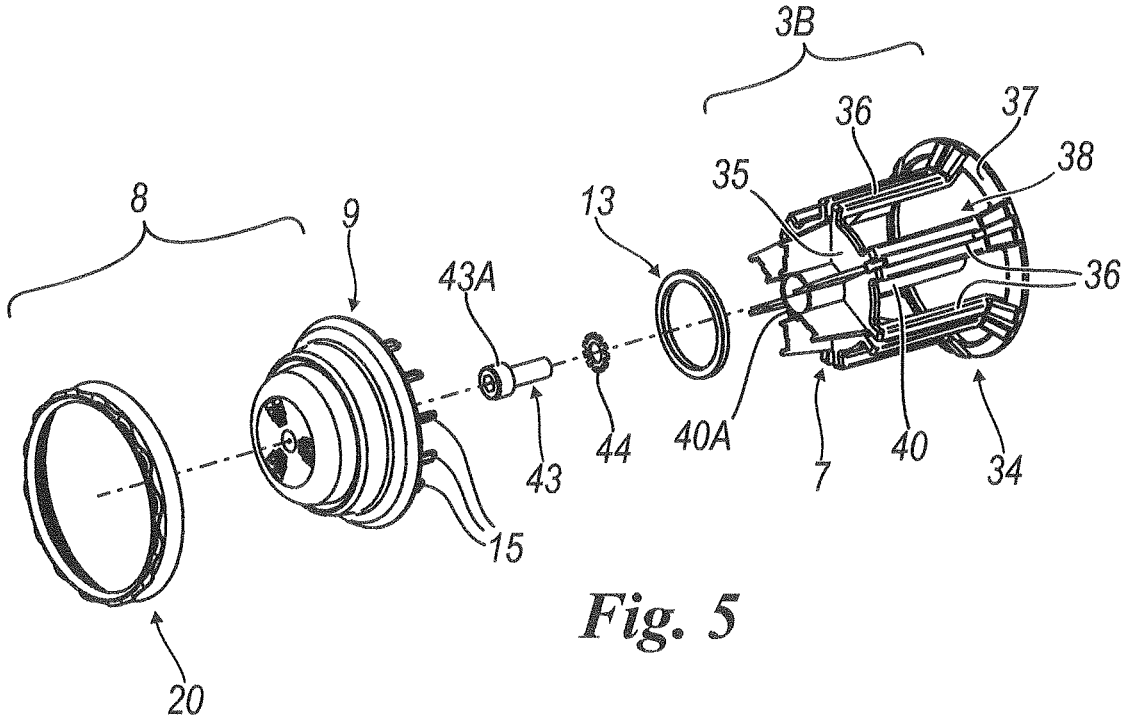
FIG. 5 is a perspective view similar to that of FIG. 4, but from a different angle.

With reference to the above-mentioned Figures, a storage yarn feeder is shown generally by 1 and comprises a body 2 bearing a drum 3 onto which is wound a yarn 4. The latter unwinds from a reel and is fed to a textile machine, neither of which is shown.

The drum 3 can be of the fixed type or rotating type. In the example shown in the Figures it is rotated about a longitudinal axis W by an electric motor 6 located inside the body 2. A feeder of this type is well known and will not be further described except for those parts necessary for an understanding of the present invention.

At one terminal end 7 of the drum 3 (from which the yarn detaches on its path towards the textile machine) a braking organ 8 is positioned which, in the example shown in the Figures, is of a magnetic-operation type. This braking organ 8, in the embodiment in question, comprises a first truncated cone or cupped body 9 having an internal cavity 10 capable of accommodating the terminal end 7 of the drum 3.

The body 9 is separated from the drum 3 but is connected to said end 7 in any known way. For example, a magnetic ring 13 is provided capable of being fixed to the cupped body 9 and of cooperating magnetically with the above-mentioned end 7, the latter also possibly being provided with a magnetic ring of the appropriate polarity to cooperate with the ring 13 in order to secure the cupped body 9 to the drum 3.

Obviously, the body 9 can be mechanically fixed (for example by screws, interlocking, snap fit or other means) to the drum 3. This body has protuberances 15 around and inside the cavity 10 capable of interfering with the end part 7 to facilitate the connection of said body to said drum 3.

Alternatively, the body 9 can form a part of the drum or define the end 7 thereof.

The braking organ 8 comprises a second body 20 at least partly conical capable of cooperating, in a known way (for example magnetically), with the first body 9 (both as an independent part of the drum and as a portion thereof) in order to tighten between them the yarn 4 appropriately inserted between said bodies 9 and 20 when starting to use the feeder. The second body 20 is movable in relation to the first 9 so as to be able to generate a braking force on the yarn that is regulated as required.

This braking organ, of magnetic, mechanical or other type is of a known type and will not be further described.

The drum 3 comprises two portions, 3A and 3B. The first portion 3A is connected to the body 2 by means of a system of bearings that enable it to rotate freely and tilt in order to create a motion to separate the coils deposited on the drum 3B and, in the embodiment shown in the Figures, is indirectly driven by the motor 6 and rotated by the latter about the axis W. This is performed in a known way.

Inside a first portion 3A of the drum 3 there is also a hollow shaft 30 having a free end 31, to which the screw 43 is fixed, this hollow shaft of the motor is appropriately threaded in order to secure the above-mentioned elements.

The second portion 3B of the drum 3, capable of directly supporting the yarn 4, comprises a body 34 having the end 7 of the drum and to which is directly fixed the cupped body 9. This second portion 3B comprises a surface 35 from the edge of which extend uprights 36 connected at the other end to a ring 37 capable of fitting onto the first part 3A of the drum. These uprights and ring, together with the surface 35, define a cupped structure capable of fitting onto said first part 3A (which is thus contained in a cavity 38 of the second part 3B of the drum).

From the surface 35, within the cavity 38 projects a hollow cylindrical body 40, with a through hole, capable of partially accommodating the tubular element 30 of the first part 3A (from its end 31) of the drum 3 and of guiding towards said end 31A a screw 43 (associated with a lock washer 44) which, introduced into the body 40 from one of its ends 40A, fixes into the element 30 and (removably) secures the second part 3B of the drum to the first part 3A. For example, this securing is achieved by the cooperation of the head 43A of the screw 43 with an internal step 47 of the cylindrical body 40.

In this way, the portions of the feeder 1 that are in contact with the yarn can be easily replaced when worn. In fact, during the use of the feeder, the yarn that winds onto the part 3B of the drum (forming coils on the uprights 36) and that runs between the bodies 9 and 20 of the braking organ 8 can friction—wear the surfaces with which it comes into contact. Thanks to the invention, not only can the braking organ 8 be easily separated from the body 2 of the feeder 1 (thus enabling one or both of its portions or bodies 9 and 20 to be replaced) by detaching part 9 from the drum 3 by overcoming the reciprocal magnetic attraction but so too can part 20 be separated from said part 9. Also part 3B of the drum 3 in contact with the yarn can be replaced with a similar part capable of accommodating the coils of yarn 4. To do this, without even detaching the feeder from the machine (or separating it only momentarily), the screw 43 is removed from the element 30 of the first part 3A of the drum. The second part 3B can thus be separated from the first 3A and replaced with an unworn part.

By retightening the screw 43 in the element 30, the drum is reassembled and the feeder 1 is ready for use.

All this is achieved using simple and rapid methods.

Thanks to the invention, therefore, a storage yarn feeder with a braking organ can be easily overhauled or have parts subject to wear replaced directly at the place of use in a matter of a few seconds, avoiding lengthy stoppages of the textile machine to which it is connected, long waiting times for the overhauled feeder and high costs.

One embodiment of the invention has been described. Others are possible, however: for example parts 3A, 3B of the drum can be connected in a removable manner also by securing means other than screw 43, for example magnetically or by mechanical interference. Or, the braking magnetic organ 8 can also be of a type other than the magnetic type described and, as stated, part 3B can itself serve as a component of the braking organ.

These solutions are also to be deemed to fall within the scope of the invention as defined by the following claims.

The invention claimed is:

1. A storage yarn feeder comprising a body having a portion or drum onto which winds a yarn forming at least one coil, said yarn coming from a reel, a braking organ cooperating with said drum to brake the yarn leaving said drum, said braking organ comprising braking means for cooperating with the yarn when the yarn detaches from the drum as the yarn leaves the feeder and heads towards a textile machine, wherein the drum comprises a first portion and a second portion, the second portion of the drum for directly supporting the yarn and being either capable of supporting a first body of the braking organ or of acting as part of the braking organ, with the first body of the braking organ being part of the second portion of the drum said first body of the braking organ connected to the second portion of the drum and connected to a second body of the braking organ movable in relation to the first body the braking organ and cooperating therewith to brake the yarn interposed between said first body of the braking organ and second body of the braking organ, the first body of the braking organ being in the form of a cup, fitted onto a terminal end of the second portion of the drum and being provided with mechanical or magnetic means of securing the first body of the braking organ to the terminal end, the second portion of the drum being separable from the first portion of the drum to be capable of being replaced, the first portion of the drum being connected to the body of the feeder, and the first portion configured to rotate freely with respect to said body and to tilt in order to create a motion to separate the coils deposited on said second portion.

2. The feeder according to claim 1, wherein the second body is at least partly conical.

3. The feeder according to claim 1, wherein removable securing means are provided, capable of securing the second portion of said drum to the first portion of said drum and of enabling the separation of said first and second portions.

4. The feeder according to claim 3, wherein said securing means are mechanical means.

5. The feeder according to claim 4, wherein these mechanical means are at least one screw or elements that connect by interference between said portions.

6. The feeder according to claim 3, wherein said securing means are magnetic means.

7. The feeder according to claim 1, wherein the braking organ is of a magnetic type and separable from the body of the feeder.

8. The feeder according to claim 1, wherein the braking organ comprises a braking element capable of cooperating directly with the second portion of the drum in order to brake the yarn located between said second portion and said braking element.

9. The feeder according to claim 1, wherein the braking organ comprises a first truncated cone having an internal cavity capable of accommodating the terminal end of the drum.

10. The feeder according to claim 1, wherein the first body has an internal cavity capable of accommodating the terminal end of the second portion of the drum.

11. The feeder according to claim 1, wherein, a first magnetic ring is provided as the magnetic means capable of being fixed to the cupped first body and of cooperating magnetically with the terminal end of the second portion of the drum.

12. The feeder according to claim 11, wherein the terminal end of the drum is provided with a second magnetic ring of appropriate polarity to cooperate with the first magnetic ring to secure the cupped first body to the terminal end of the second portion of the drum.

13. The feeder according to claim 12, wherein the cupped first body has protuberances around and inside the cavity capable of interfering with the terminal end of the second portion of the drum to facilitate the connection of the cupped first body to the drum.

14. The feeder according to claim 1, wherein the second body is at least partly conical and defines a cavity therein.

15. The feeder according to claim 1, wherein, when the first portion is connected to the second portion, the body, the first portion, and the second portion are longitudinally axially aligned along the same longitudinal axis.

16. The feeder according to claim 15, wherein the first portion is detachable from the second portion to detach along the longitudinal axis.

17. The feeder according to claim 15, wherein the first portion and the second portion each have a respective internal cylinder longitudinally aligned along the longitudinal axis, wherein, wherein one said internal cylinder has a hollow end for accommodating an end of the other said internal cylinder for detachably mating when the first portion is connected to the second portion.

* * * * *